US011486416B2

(12) United States Patent
Kondo et al.

(10) Patent No.: US 11,486,416 B2
(45) Date of Patent: Nov. 1, 2022

(54) HYDRAULIC SYSTEM

(71) Applicant: KAWASAKI JUKOGYO KABUSHIKI KAISHA, Kobe (JP)

(72) Inventors: Akihiro Kondo, Kobe (JP); Hiroaki Mitsui, Kobe (JP); Toshihisa Toyota, Kobe (JP); Koki Mibu, Kobe (JP); Takashi Nakatsuji, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 17/295,355

(22) PCT Filed: Nov. 15, 2019

(86) PCT No.: PCT/JP2019/044915

§ 371 (c)(1),
(2) Date: May 19, 2021

(87) PCT Pub. No.: WO2020/105559

PCT Pub. Date: May 28, 2020

(65) Prior Publication Data

US 2022/0010817 A1 Jan. 13, 2022

(30) Foreign Application Priority Data

Nov. 19, 2018 (JP) ..... JP2018-216517

(51) Int. Cl.
*F15B 7/00* (2006.01)
*F04B 17/03* (2006.01)

(52) U.S. Cl.
CPC ..... *F15B 7/001* (2013.01); *F04B 17/03* (2013.01); *F15B 2215/30* (2013.01)

(58) Field of Classification Search
CPC ..... F15B 2211/7128; F15B 2211/7053; F15B 21/14; F15B 11/022; F04B 23/04; F04B 49/007; F04B 17/03; B30B 15/161
See application file for complete search history.

(56) References Cited

FOREIGN PATENT DOCUMENTS

DE 102013008047 A1 * 11/2014 ..... F03D 7/0224
JP H07-127606 A 5/1995
(Continued)

OTHER PUBLICATIONS

Machine Translation of DE-102013008047.*

*Primary Examiner* — Thomas E Lazo
*Assistant Examiner* — Daniel S Collins
(74) *Attorney, Agent, or Firm* — Oliff PLC

(57) ABSTRACT

A hydraulic system includes: a cylinder in which an interior of a tube is divided by a piston into a first pressure chamber and a second pressure chamber; a first bidirectional pump connected to the first pressure chamber by a first supply/discharge line; a second bidirectional pump connected to the second pressure chamber by a second supply/discharge line and coupled to the first bidirectional pump in a manner enabling torque to be transmitted between the first and second bidirectional pumps; a relay line connecting the first and second bidirectional pumps such that a hydraulic liquid discharged from one of the first and second bidirectional pumps is introduced into the other of the first and second bidirectional pumps; and an electric motor that drives the first or second bidirectional pump. At least one of the first and second bidirectional pumps is a variable displacement pump whose delivery capacity per rotation is freely variable.

6 Claims, 5 Drawing Sheets

(56) References Cited

FOREIGN PATENT DOCUMENTS

| | | | | |
|---|---|---|---|---|
| JP | H11-117907 | A | 4/1999 | |
| JP | 2002-021807 | A | 1/2002 | |
| JP | 2002-048105 | A | 2/2002 | |
| JP | 4402830 | B2 | 1/2010 | |
| WO | WO-2006060638 | A2 * | 6/2006 | ..... F15B 1/024 |

* cited by examiner

HYDRAULIC SYSTEM

TECHNICAL FIELD

The present invention relates to a hydraulic system including a cylinder.

BACKGROUND ART

For example, a known hydraulic system for incorporation into a press machine or the like includes a single-rod cylinder that moves a moving object such as a movable die in the vertical direction and a bidirectional pump connected to the cylinder such that a closed circuit is formed. The bidirectional pump is typically driven by a servomotor.

For example, Patent Literature 1 discloses a hydraulic system 100 as shown in FIG. 5 which is for incorporation into a press machine. This hydraulic system 100 includes a single-rod cylinder 110 disposed such that a rod 112 projects downward from a tube 111 closed at both ends. That is, a moving object (movable die) 160 is lowered by extension of the rod 112 and raised by retraction of the rod 112.

A rod-side chamber 113 of the cylinder 110 is connected to a bidirectional pump 140 by a first supply/discharge line 120, and a head-side chamber 114 of the cylinder 110 is connected to the bidirectional pump 140 by a second supply/discharge line 130. The first supply/discharge line 120 is provided with a counterbalance valve 121. Further, a bypass line 122 is connected to the first supply/discharge line 120 in such a manner as to bypass the counterbalance valve 121, and the bypass line 122 is provided with a speed-switching valve 123.

The lowering speed of the moving object 160 is switched by the speed-switching valve 123 between an approaching speed which is relatively high and a working speed which is relatively low. That is, during pressing, a reactive force is applied against extension of the rod by means of the counterbalance valve 121.

CITATION LIST

Patent Literature

PTL 1: Japanese Patent No. 4402830

SUMMARY OF INVENTION

Technical Problem

In the configuration like that of the hydraulic system 100 shown in FIG. 5, where during pressing a reactive force is applied against extension of the rod by means of the counterbalance valve, the speed, stroke, and thrust of the cylinder can be stably controlled (hereinafter, the speed, stroke, and thrust of a cylinder will be collectively referred to as "the speed etc." of the cylinder). However, in this configuration, energy loss occurs due to passing of the hydraulic liquid through the counterbalance valve. In some cases, the counterbalance valve is used to apply a reactive force against retraction of the rod.

The counterbalance value can be used also when the rod projects in a direction opposite to the projecting direction in FIG. 5, namely when the rod projects upward from the tube or when the axial direction of the single-rod cylinder is horizontal, in order to apply a reactive force against extension or retraction of the rod and thus stably control the speed etc. of the cylinder. These configurations also suffer from energy loss occurring due to passing of the hydraulic liquid through the counterbalance valve. Further, the counterbalance valve can be used to stably control the speed etc. of a double-rod cylinder by applying a reactive force against the movement of the rods relative to the tube.

The present invention aims to provide a hydraulic system able to stably control the speed etc. of a cylinder without the use of any counterbalance valve.

Solution to Problem

In order to solve the problem described above, a hydraulic system of the present invention includes: a cylinder in which an interior of a tube is divided by a piston into a first pressure chamber and a second pressure chamber; a first bidirectional pump connected to the first pressure chamber by a first supply/discharge line; a second bidirectional pump connected to the second pressure chamber by a second supply/discharge line and coupled to the first bidirectional pump in a manner enabling torque to be transmitted between the first and second bidirectional pumps; a relay line connecting the first and second bidirectional pumps such that a hydraulic liquid discharged from one of the first and second bidirectional pumps is introduced into the other of the first and second bidirectional pumps; and an electric motor that drives the first or second bidirectional pump, wherein at least one of the first and second bidirectional pumps is a variable displacement pump whose delivery capacity per rotation is freely variable.

In the above configuration, since the second bidirectional pump is coupled to the first bidirectional pump in a manner enabling torque to be transmitted between the first and second bidirectional pumps, both the first and second bidirectional pumps are driven once one of the pumps is driven by the electric motor. Additionally, since at least one of the first and second bidirectional pumps is a variable displacement pump whose delivery capacity per rotation is freely variable, the delivery capacity ratio between the first and second bidirectional pumps can be appropriately set even if the rotational speed ratio between the first and second bidirectional pumps is constant. Thus, a reactive force can, without the use of any counterbalance valve, be applied against extension or retraction of the rod when the cylinder is a single-rod cylinder and against the movement of the rods relative to the tube when the cylinder is a double-rod cylinder. In consequence, the speed etc. of the cylinder can be stably controlled.

Further, special benefits are achieved by the fact that the second bidirectional pump is coupled to the first bidirectional pump in a manner enabling torque to be transmitted between the first and second bidirectional pumps. For example, when the cylinder is disposed to move a moving object in the vertical direction, the potential energy of the moving object can, during lowering of the moving object, be recovered in the form of rotational torque by one of the first and second bidirectional pumps (the pump into which the hydraulic liquid discharged from the cylinder flows). When the cylinder is disposed to move the moving object in the horizontal direction, the drive power of the one of the first and second bidirectional pumps can be recovered in the form of torque for generating a reactive force against extension or retraction of the rod. Thus, the driving of the other of the first and second bidirectional pumps can be assisted regardless of the movement direction of the moving object.

One of the first and second bidirectional pumps may be a variable displacement pump whose delivery capacity per rotation is freely variable, and the other of the first and second bidirectional pumps may be a fixed displacement pump whose delivery capacity per rotation is invariable or a variable displacement pump whose delivery capacity per rotation is selectively switchable between a first fixed value and a second fixed value. In this configuration, the cost can be reduced compared to that required when both the first and second bidirectional pumps are variable displacement pumps.

Alternatively, both the first and second bidirectional pumps may be variable displacement pumps whose delivery capacities per rotation are freely variable. In this configuration, the flow rate control can be performed more flexibly than when one of the first and second bidirectional pumps is a fixed displacement pump or a variable displacement pump whose delivery capacity is selectively switchable.

The first bidirectional pump may include a cylinder-side port (a pump port connected to the cylinder) and a cylinder-opposite port (a pump port connected to an element other than the cylinder) having a larger diameter than the cylinder-side port, and the second bidirectional pump may include a cylinder-side port and a cylinder-opposite port having a larger diameter than the cylinder-side port. In this configuration, since the internal passage of each of the first and second bidirectional pumps that communicates with the cylinder-opposite port is subjected to a lower pressure than the passage communicating with the cylinder-side port, the internal passage need not be strong enough to withstand high pressures and can have an increased passage area. This can reduce the pressure drop which occurs when the hydraulic liquid is passing through the passage.

For example, the cylinder may be a double-rod cylinder or a single-rod cylinder.

The hydraulic system may further include: an inlet line connecting the relay line and a tank; a check valve disposed in the inlet line to permit a flow from the tank toward the relay line and prohibit the opposite flow; an outlet line connecting the relay line and the tank; and an outlet valve disposed in the outlet line to permit a flow from the relay line toward the tank when a pressure in the relay line is higher than a preset value. In this configuration, insufficient flow rate of the hydraulic liquid sucked into the first or second bidirectional pump and excessive increase in pressure in the relay line can be prevented.

Advantageous Effects of Invention

According to the present invention, the speed etc. of a cylinder can be stably controlled without the use of any counterbalance valve.

DESCRIPTION OF EMBODIMENTS

Embodiment 1

Figure 1:
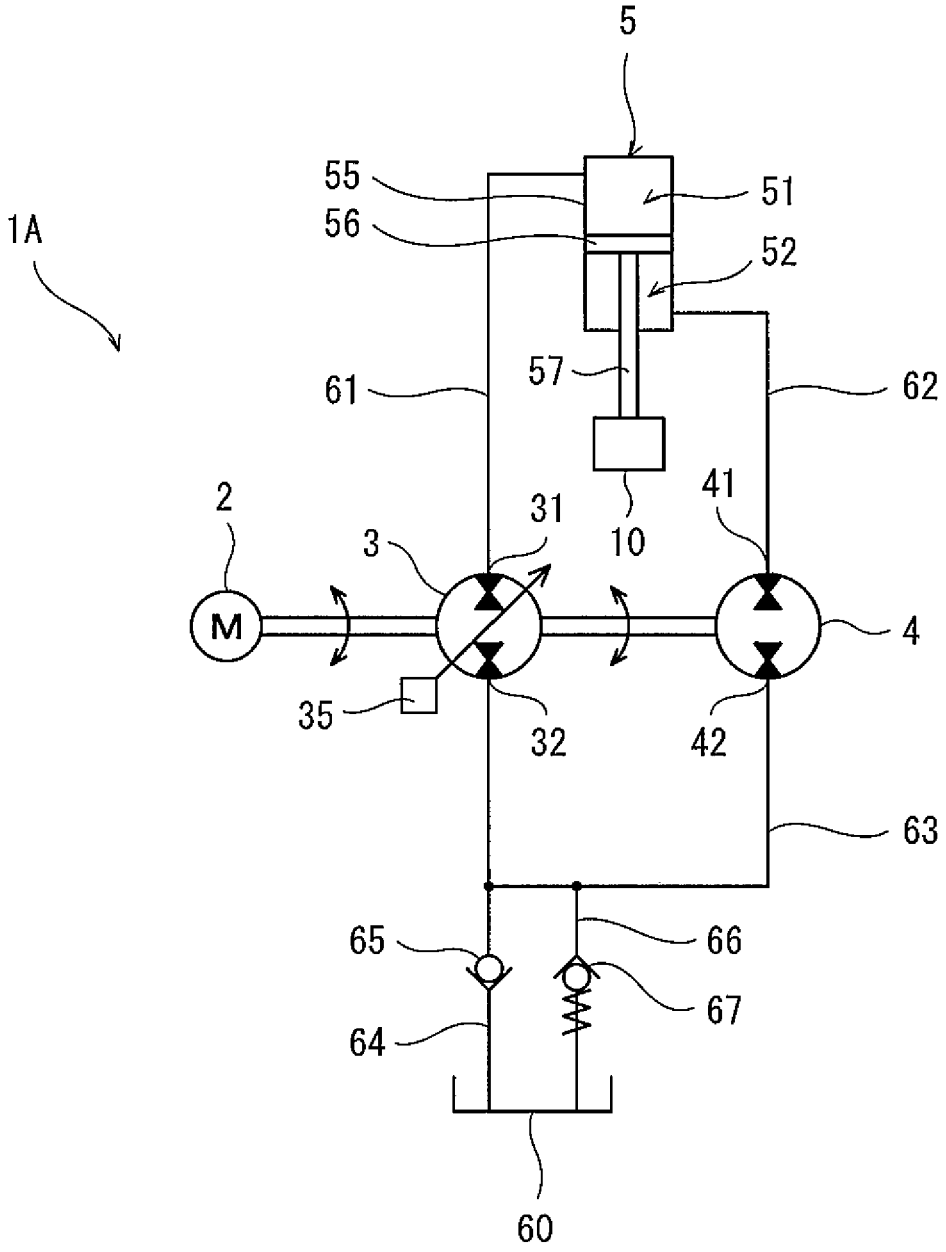
FIG. 1 is a schematic configuration diagram of a hydraulic system according to Embodiment 1 of the present invention.

FIG. 1 shows a hydraulic system 1A according to Embodiment 1 of the present invention. This hydraulic system 1A is incorporated, for example, into a press machine. The hydraulic liquid used in the hydraulic system 1A is typically an oil, and may be another liquid such as water.

The hydraulic system 1A includes a cylinder 5. In the present embodiment, the cylinder 5 is a single-rod cylinder 5 that moves a moving object 10 in the vertical direction. The axial direction of the cylinder 5 need not be exactly parallel to the vertical direction, and may be slightly inclined with respect to the vertical direction (for example, the angle of inclination with respect to the vertical direction is 10 degrees or less). Alternatively, the axial direction of the cylinder 5 may be horizontal or oblique.

The hydraulic system 1A further includes a first bidirectional pump 3 and a second bidirectional pump 4 which are connected to the cylinder 5 such that a closed circuit is formed. The closed circuit is connected to a tank 60 by an inlet line 64 and an outlet line 66.

The cylinder 5 includes: a tube 55 closed at both ends by a head cover and a rod cover; a piston 56 dividing the interior of the tube 55 into a first pressure chamber 51 located on the head cover side and a second pressure chamber 52 located on the rod cover side; and a rod 57 extending from the piston 56 and penetrating through the rod cover. That is, in the present embodiment, the first pressure chamber 51 is a head-side chamber, and the second pressure chamber 52 is a rod-side chamber. The moving object 10 is mounted on the tip of the rod 57.

In the present embodiment, the cylinder 5 is disposed such that the rod 57 projects downward from the tube 55. That is, the first pressure chamber 51 is located on the upper side, the second pressure chamber 52 is located on the lower side, and the second pressure chamber is pressurized by the rod 57 and the weight of the moving object 10. Alternatively, the cylinder 5 may be disposed such that the rod 57 projects upward from the tube 55 and that the second pressure chamber 52 is located on the upper side and the first pressure chamber 51 is located on the lower side.

The first bidirectional pump 3 includes a cylinder-side port 31 and a cylinder-opposite port 32 that switch between functioning as a suction port and functioning as a delivery port depending on the rotational direction of the pump. The cylinder-side port 31 is connected to the first pressure chamber 51 of the cylinder 5 by a first supply/discharge line 61. The cylinder-side port 31 is designed to withstand high pressures, and the cylinder-opposite port 32 is held at a low pressure. Thus, the cylinder-opposite port 32 has a larger diameter than the cylinder-side port 31.

The second bidirectional pump 4 includes a cylinder-side port 41 and a cylinder-opposite port 42 that switch between functioning as a suction port and functioning as a delivery port depending on the rotational direction of the pump. The cylinder-side port 41 is connected to the second pressure chamber 52 of the cylinder 5 by a second supply/discharge line 62. The cylinder-side port 41 is designed to withstand high pressures, and the cylinder-opposite port 42 is held at a low pressure. Thus, the cylinder-opposite port 42 has a larger diameter than the cylinder-side port 41.

The cylinder-opposite port 42 of the second bidirectional pump 4 is connected to the cylinder-opposite port 32 of the first bidirectional pump 3 by a relay line 63. Thus, the hydraulic liquid discharged from one of the first and second bidirectional pumps 3 and 4 is introduced into the other of the first and second bidirectional pumps 3 and 4 through the relay line 63.

The inlet and outlet lines 64 and 66 mentioned above connect the relay line 63 and the tank 60. The inlet line 64 is provided with a check valve 65, and the outlet line 66 is provided with an outlet valve 67. The check valve 65 permits a flow from the tank 60 toward the relay line 63 and prohibits the opposite flow.

The outlet valve 67 permits a flow from the relay line 63 toward the tank 60 when the pressure in the relay line 63 is higher than a preset value (e.g., 0.1 to 2 MPa), and otherwise prohibits the flow between the relay line 63 and the tank 60. In the present embodiment, the outlet valve 67 is a check valve whose cracking pressure is set to a somewhat high value. Alternatively, the outlet valve 67 may be a relief valve.

The first and second bidirectional pumps 3 and 4 are coupled together in a manner enabling torque to be transmitted between them. In the present embodiment, the first and second bidirectional pumps 3 and 4 are coaxially arranged. For example, the rotating shafts of the first and second bidirectional pumps 3 and 4 are coupled directly by means such as a coupling.

Alternatively, a plurality of gears may be disposed between the rotating shafts of the first and second bidirectional pumps 3 and 4, and the first and second bidirectional pumps 3 and 4 may be arranged in parallel. In this case, the rotational speeds of the first and second bidirectional pumps 3 and 4 may be different.

In the present embodiment, the first bidirectional pump 3 is a variable displacement pump (a swash plate pump or bent axis pump) whose delivery capacity per rotation is freely variable, and the second bidirectional pump 4 is a fixed displacement pump whose delivery capacity per rotation is invariable. The tilt angle of the first bidirectional pump 3, which defines the delivery capacity, is regulated by a regulator 35. For example, when the first bidirectional pump 3 is a swash plate pump, the regulator 35 may be a regulator that electrically varies the hydraulic pressure acting on a servo piston coupled to the swash plate of the first bidirectional pump 3, or may be an electric actuator coupled to the swash plate of the first bidirectional pump 3.

Figure 2:
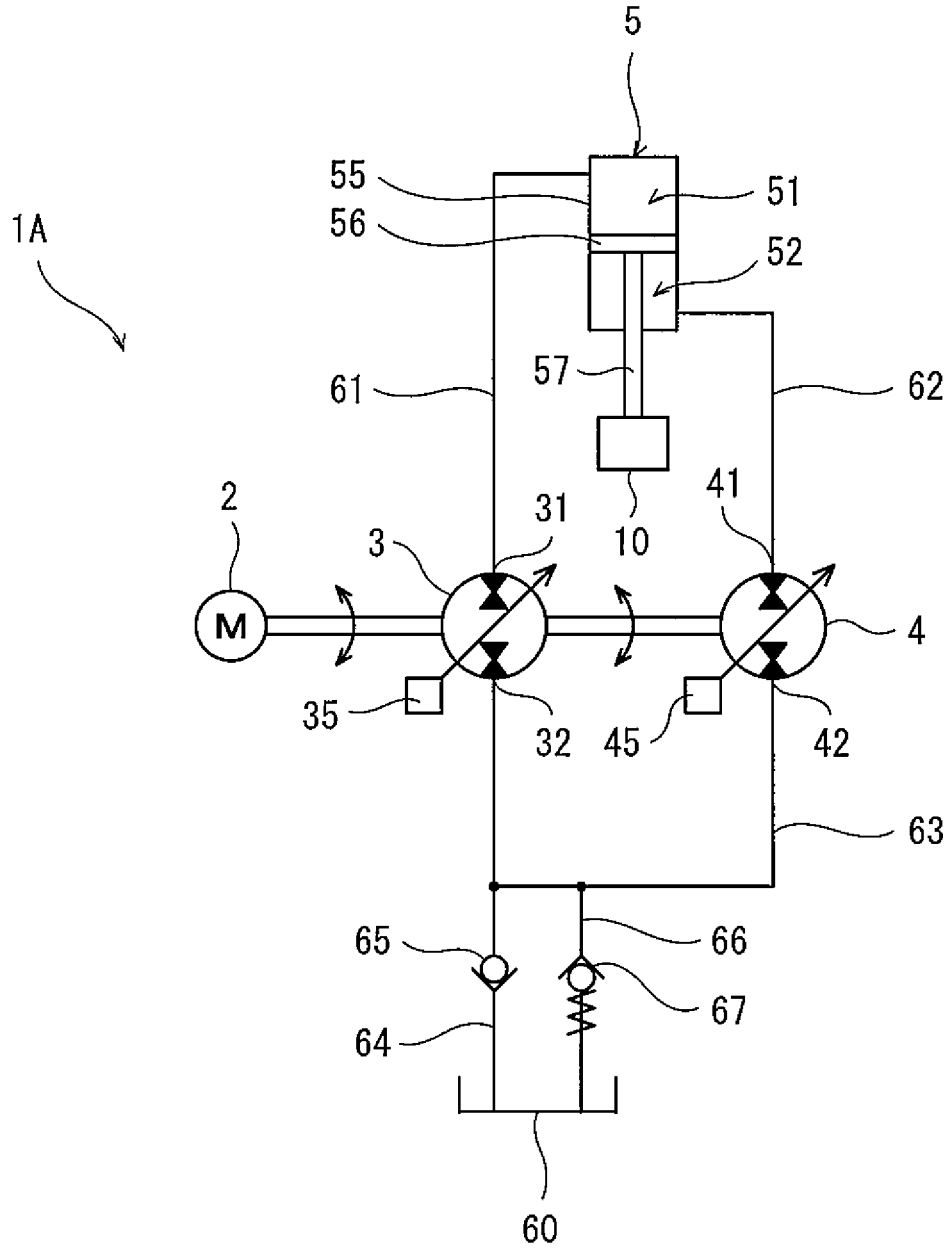
FIG. 2 is a schematic configuration diagram of a hydraulic system of a modification example of Embodiment 1.

It should be noted that the second bidirectional pump 4 may, as shown in FIG. 2, be a variable displacement pump (a swash plate pump or bent axis pump) whose delivery capacity per rotation is selectively switchable between a first fixed value q1 and a second fixed value q2 greater than the first fixed value q1. In this configuration, the speed of the cylinder 5 can be switched between a low speed and a high speed. In this case, the tilt angle of the second bidirectional pump 4, which defines the delivery capacity, is regulated by a regulator 45. For example, when the second bidirectional pump 4 is a swash plate pump, the regulator 45 may be a regulator that electrically varies the hydraulic pressure acting on a servo piston coupled to the swash plate of the second bidirectional pump 4 or may be an electric actuator coupled to the swash plate of the second bidirectional pump 4.

Referring back to FIG. 1, in the present embodiment, the first bidirectional pump 3 is driven by an electric motor 2. For example, the rotating shafts of the first bidirectional pump 3 and electric motor 2 are coupled directly by means such as a coupling. Alternatively, the rotating shaft of the electric motor 2 may be coupled to the rotating shaft of the second bidirectional pump 4, and the second bidirectional pump 4 may be driven by the electric motor 2. It is desirable to use a servomotor as the electric motor 2. However, a common motor may be used as the electric motor 2.

In the hydraulic system 1A of the present embodiment, as described above, the second bidirectional pump 4 is coupled to the first bidirectional pump 3 in a manner enabling torque to be transmitted between the first and second bidirectional pumps 3 and 4, and thus the second bidirectional pump 4 is driven together with the first bidirectional pump 3 once the first bidirectional pump 3 is driven by the electric motor 2. Additionally, since the first bidirectional pump 3 is a variable displacement pump whose delivery capacity per rotation is freely variable, the delivery capacity ratio between the first and second bidirectional pumps 3 and 4 can be appropriately set according to the difference in area between the first and second pressure chambers 51 and 52 of the cylinder 5 even if the rotational speed ratio between the first and second bidirectional pumps 3 and 4 is constant. The fact that the first bidirectional pump 3 is a variable displacement pump further makes it possible to more appropriately control the pressures in the two supply/discharge lines 61 and 62 despite the influence of factors such as the compressibility in the supply/discharge lines 61 and 62. Thus, a reactive force can be applied against extension of the cylinder 5 without the use of any counterbalance valve. In consequence, the speed etc. of the cylinder 5 can be stably controlled.

Further, in the present embodiment, the potential energy of the moving object 10 can, during lowering of the moving object 10, be recovered in the form of rotational torque by the second bidirectional pump 4. Additionally, since the second bidirectional pump 4 is coupled to the first bidirectional pump 3 in a manner enabling torque to be transmitted between the first and second bidirectional pumps 3 and 4, the driving of the first bidirectional pump 3 can be assisted by the potential energy of the moving object 10. This can prevent the potential energy of the moving object 10 from being lost as heat, thus leading to energy saving. Further, since the amount of heat generated in the hydraulic liquid is reduced, the hydraulic liquid is less likely to be degraded when the hydraulic liquid is an oil.

It should be noted that the above-mentioned benefit of enabling assistance for the driving of the first bidirectional pump 3 can be obtained also when the cylinder 5 is disposed to move the moving object 10 in the horizontal direction. The reason for this is that the drive power of the first bidirectional pump 3 can be recovered in the form of torque for generating a reactive force against extension of the rod 57.

Figure 5:
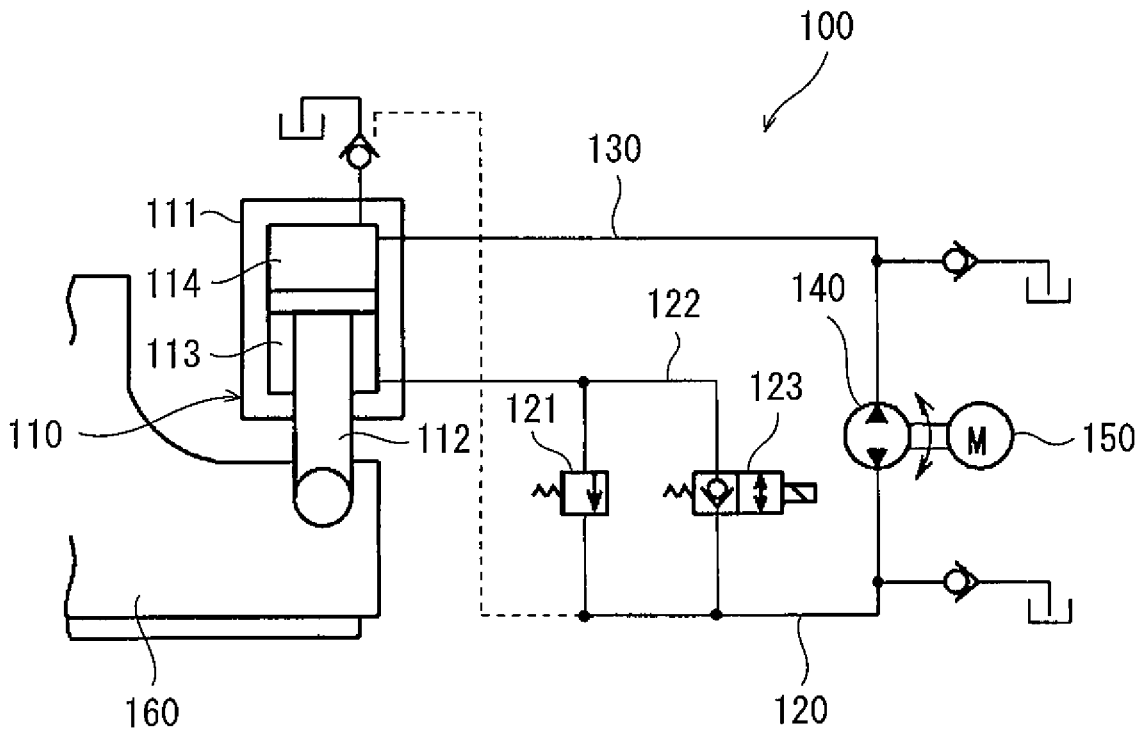
FIG. 5 is a schematic configuration diagram of a conventional hydraulic system.

In the conventional hydraulic system 100 as shown in FIG. 5, the two ports of the bidirectional pump 140 could be subjected to a high pressure, albeit not simultaneously. As such, the system 100 needs to use a special pump as the bidirectional pump 140 and requires high cost.

In contrast, in the present embodiment, the cylinder-opposite ports 32 and 42 of the first and second bidirectional pumps 3 and 4 are always held at low pressures. Thus, common pumps can be used as the first and second bidirectional pumps 3 and 4. With the use of two common pumps, the cost can be reduced compared to that required by the hydraulic system 100 using a special pump and a counterbalance valve.

In particular, when the cylinder-opposite port (32 or 42) of each of the first and second bidirectional pumps 3 and 4 has a larger diameter than the cylinder-side port (31 or 41) as in the present embodiment, since the internal passage of each pump that communicates with the cylinder-opposite port is subjected to a lower pressure than the passage communicating with the cylinder-side port, the internal passage need not be strong enough to withstand high pressures and can have an increased passage area. This can reduce the pressure drop which occurs when the hydraulic liquid is passing through the passage.

Further, since the present embodiment employs the inlet line 64 provided with the check valve 65 and the outlet line 66 provided with the outlet valve 67, insufficient flow rate of the hydraulic liquid sucked into the first or second bidirectional pump 3 or 4 and excessive increase in pressure in the relay line 63 can be prevented.

MODIFICATION EXAMPLE

Figure 3:
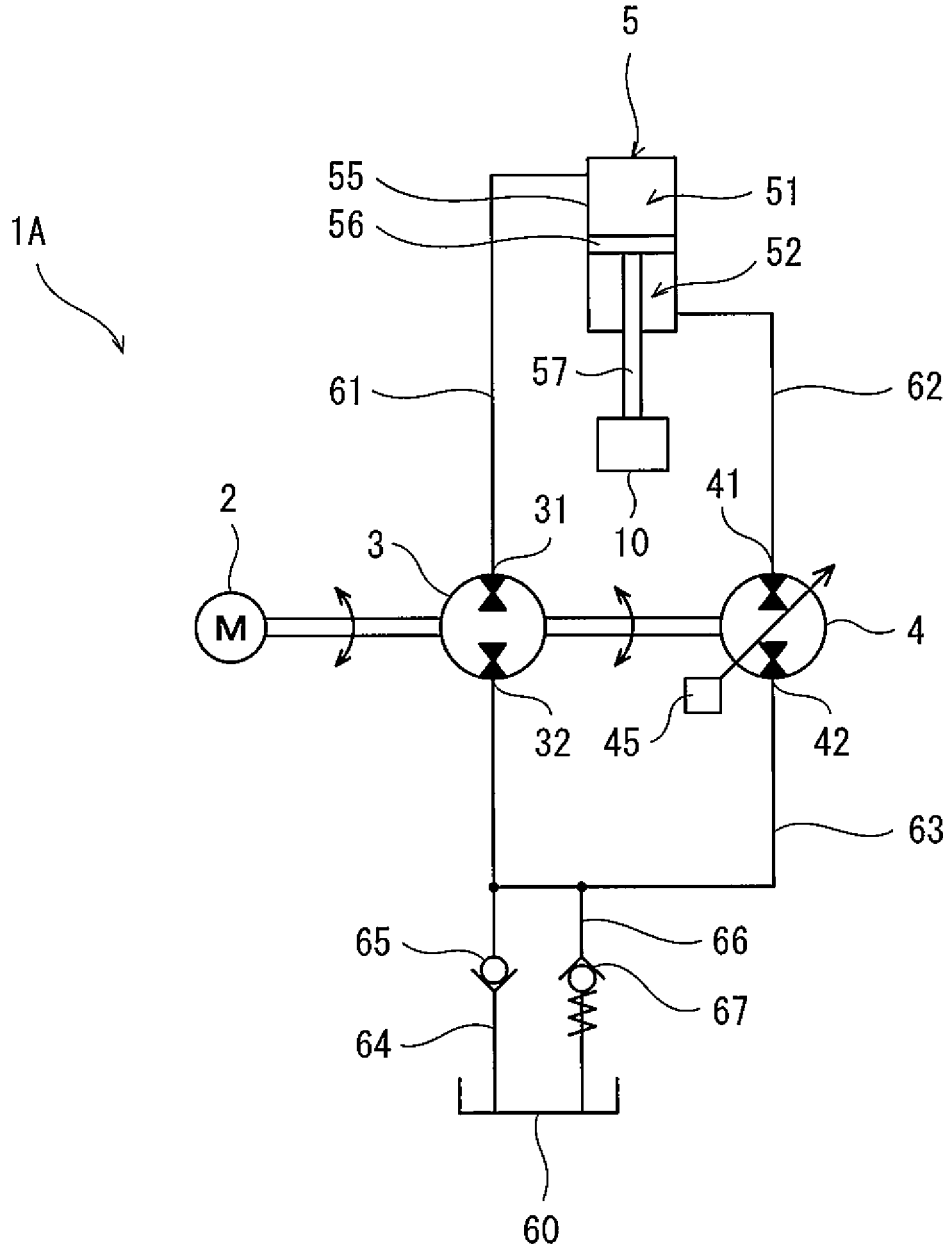
FIG. 3 is a schematic configuration diagram of a hydraulic system of another modification example of Embodiment 1.

As shown in FIG. 3, the second bidirectional pump 4 may be a variable displacement pump whose delivery capacity per rotation is freely variable, and the first bidirectional pump 3 may be a fixed displacement pump whose delivery capacity per rotation is invariable. Alternatively, when the second bidirectional pump 4 is a variable displacement pump whose delivery capacity per rotation is freely variable, the first bidirectional pump 3 may be a variable displacement pump whose delivery capacity per rotation is selectively switchable between a first fixed value q1 and a second fixed value q2.

Alternatively, both the first and second bidirectional pumps 3 and 4 may be variable displacement pumps whose delivery capacities per rotation are freely variable. In this configuration, the flow rate control can be performed more flexibly than when one of the first and second bidirectional pumps 3 and 4 is a fixed displacement pump or a variable displacement pump whose delivery capacity is selectively switchable. It should be noted, however, that when one of the first and second bidirectional pumps 3 and 4 is a fixed displacement pump or a variable displacement pump whose delivery capacity is selectively switchable as shown in FIG. 1 or 3, the cost can be reduced compared to that required when both the first and second bidirectional pumps 3 and 4 are variable displacement pumps whose delivery capacities per rotation are freely variable.

Embodiment 2

Figure 4:
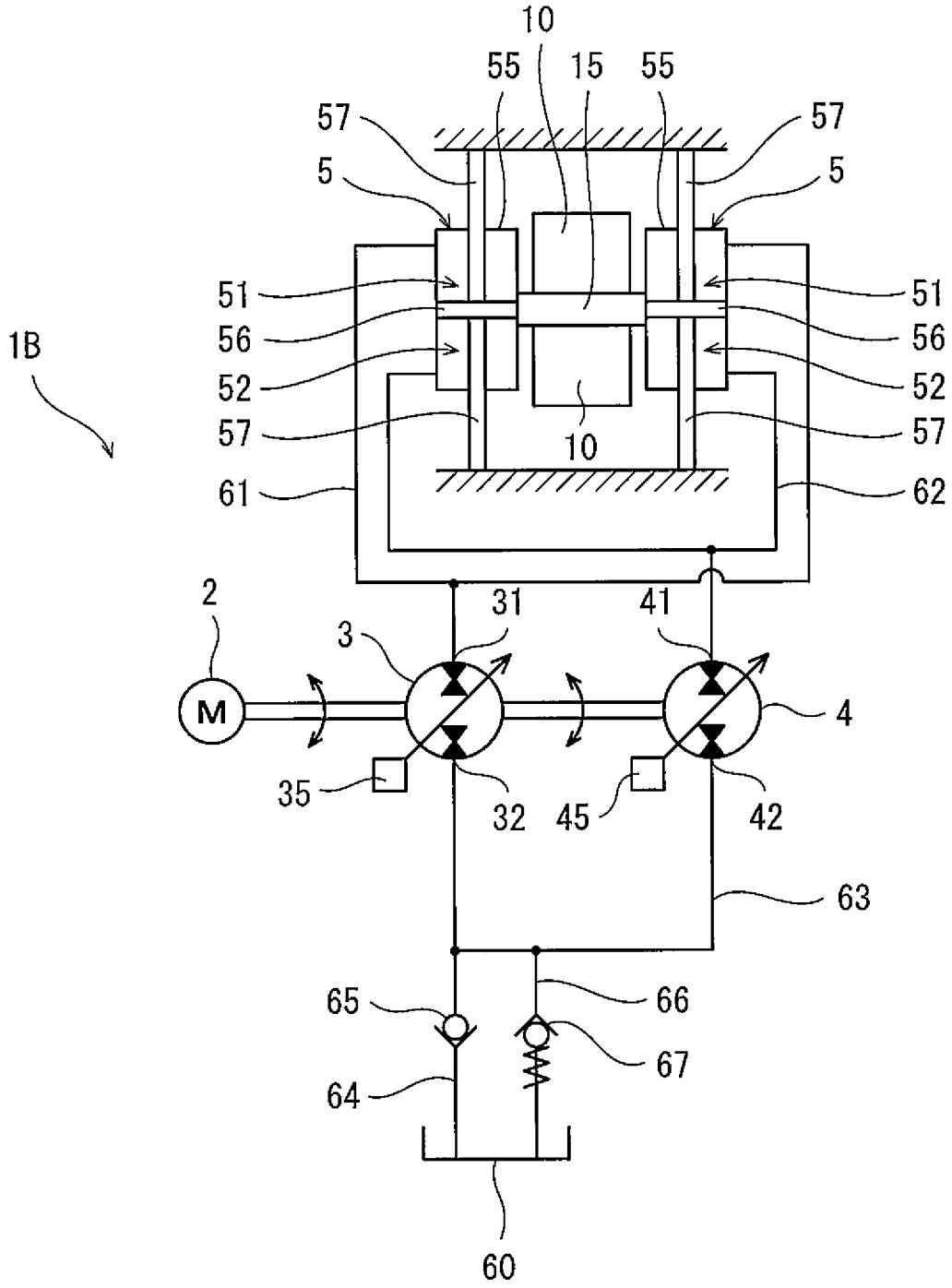
FIG. 4 is a schematic configuration diagram of a hydraulic system according to Embodiment 2 of the present invention.

FIG. 4 shows a hydraulic system 1B according to Embodiment 2 of the present invention. In the present embodiment, the elements which are the same as those of Embodiment 1 are denoted by the same reference signs, and repeated descriptions of these elements will not be given.

In the hydraulic system 1B of the present embodiment, a plurality of cylinders 5 (two cylinders 5 in the illustrated example) are employed, and they are double-rod cylinders. That is, both ends of the tube 55 of each cylinder 5 are closed by two rod covers, and the two rods 57 penetrate through the rod covers, respectively.

In the present embodiment, all the rods 57 are fixed, and the tubes 55 of all the cylinders 5 are coupled together by a movable table 15. The moving objects 10 are mounted on the upper and lower surfaces of the movable table 15.

In such a configuration, when at least one of the first and bidirectional pumps 3 and 4 is a variable displacement pump whose delivery capacity per rotation is freely variable, as in the configuration of Embodiment 1, the delivery capacity ratio between the first and second bidirectional pumps 3 and 4 can be appropriately set even if the rotational speed ratio between the first and second bidirectional pumps 3 and 4 is constant (e.g., a ratio other than 1:1). Further, with at least one of the first and bidirectional pumps 3 and 4 being a variable displacement pump, the pressures in the two supply/discharge lines 61 and 62 can be more appropriately controlled despite the influence of factors such as the compressibility in the supply/discharge lines 61 and 62, even if the amount of pump internal leakage varies due to a difference in pressure level. Thus, a reactive force can be applied against the movement of the rods 57 relative to the tubes 55 without the use of any counterbalance valve. In consequence, the speed etc. of the cylinders 5 can be stably controlled.

It should be noted that Embodiment 2 is identical to Embodiment 1 in that during lowering of the moving object 10, the potential energy of the moving object 10 can be recovered in the form of rotational torque by the second bidirectional pump 4 to assist the driving of the first bidirectional pump 3.

Other Embodiments

The present invention is not limited to the embodiments described above, and various modifications can be made without departing from the gist of the present invention.

REFERENCE SIGNS LIST

1A, 1B hydraulic system
2 electric motor
3 first bidirectional pump
4 second bidirectional pump
5 cylinder
51 first pressure chamber
52 second pressure chamber
55 tube
56 piston
60 tank
61 first supply/discharge line
62 second supply/discharge line
63 relay line
64 inlet line
65 check valve
66 outlet line
67 outlet valve

The invention claimed is:

1. A hydraulic system comprising:

a cylinder in which an interior of a tube is divided by a piston into a first pressure chamber and a second pressure chamber;

a first bidirectional pump connected to the first pressure chamber by a first supply/discharge line;

a second bidirectional pump connected to the second pressure chamber by a second supply/discharge line and coupled to the first bidirectional pump in a manner enabling torque to be transmitted between the first and second bidirectional pumps;

a relay line connecting the first and second bidirectional pumps such that a hydraulic liquid discharged from one of the first and second bidirectional pumps is introduced into the other of the first and second bidirectional pumps;

an electric motor that drives the first or second bidirectional pump;

an inlet line connecting the relay line and a tank;

a check valve in the inlet line to permit a flow from the tank toward the relay line and prohibit opposite flow;

an outlet line connecting the relay line and the tank; and an outlet valve in the outlet line to permit a flow from the relay line toward the tank when a pressure in the relay line is higher than a preset value, wherein at least one of the first and second bidirectional pumps is a variable displacement pump whose delivery capacity per rotation is freely variable.

2. The hydraulic system according to claim 1, wherein one of the first and second bidirectional pumps is a variable displacement pump whose delivery capacity per rotation is freely variable, and the other of the first and second bidirectional pumps is a fixed displacement pump whose delivery capacity per rotation is invariable or a variable displacement pump whose delivery capacity per rotation is selectively switchable between a first fixed value and a second fixed value.

3. The hydraulic system according to claim 1, wherein both the first and second bidirectional pumps are variable displacement pumps whose delivery capacities per rotation are freely variable.

4. The hydraulic system according to claim 1, wherein the first bidirectional pump includes a cylinder-side port and a cylinder-opposite port having a larger diameter than the cylinder-side port, and the second bidirectional pump includes a cylinder-side port and a cylinder-opposite port having a larger diameter than the cylinder-side port.

5. The hydraulic system according to claim 1, wherein the cylinder is a double-rod cylinder.

6. The hydraulic system according to claim 1, wherein the cylinder is a single-rod cylinder.

* * * * *